US005390733A

United States Patent [19]

Young

[11] Patent Number: 5,390,733

[45] Date of Patent: Feb. 21, 1995

[54] HEAT EXCHANGER MANIFOLD ASSEMBLY

[75] Inventor: Darryl L. Young, Belleville, Mich.

[73] Assignee: Ford Motor Company, Dearborn, Mich.

[21] Appl. No.: 172,788

[22] Filed: Dec. 27, 1993

[51] Int. Cl.[6] ..... F28F 9/02

[52] U.S. Cl. ..... 165/173; 165/153; 228/183; 29/890.052

[58] Field of Search ..... 165/153, 173; 228/183; 29/890.052

[56] References Cited

U.S. PATENT DOCUMENTS

| | | | |
|---|---|---|---|
| 4,546,823 | 10/1985 | Melnyk . | |
| 5,107,926 | 4/1992 | Calleson . | |
| 5,238,059 | 8/1993 | Smith | 165/173 |
| 5,297,624 | 3/1994 | Haussmann et al. | 165/173 |

FOREIGN PATENT DOCUMENTS

| | | | |
|---|---|---|---|
| 510330 | 2/1955 | Canada | 165/173 |
| 3222278 | 12/1983 | Germany . | |
| 3800739 | 7/1989 | Germany . | |
| 55-63396 | 5/1980 | Japan . | |
| 195793 | 11/1983 | Japan . | |
| 325297 | 2/1991 | Japan . | |
| 3225197 | 10/1991 | Japan . | |
| 699032 | 10/1953 | United Kingdom . | |

*Primary Examiner*—Allen J. Flanigan
*Attorney, Agent, or Firm*—Raymond L. Coppiellie; Roger L. May

[57] ABSTRACT

A manifold assembly 14 is disclosed which includes a tank member 26 and a header plate 28. Each of the tank member 26 and header plate 28 includes a flange portion 38, 50, respectively which when in a mating engagement, form at least one brazing contact surface between the two components.

8 Claims, 2 Drawing Sheets

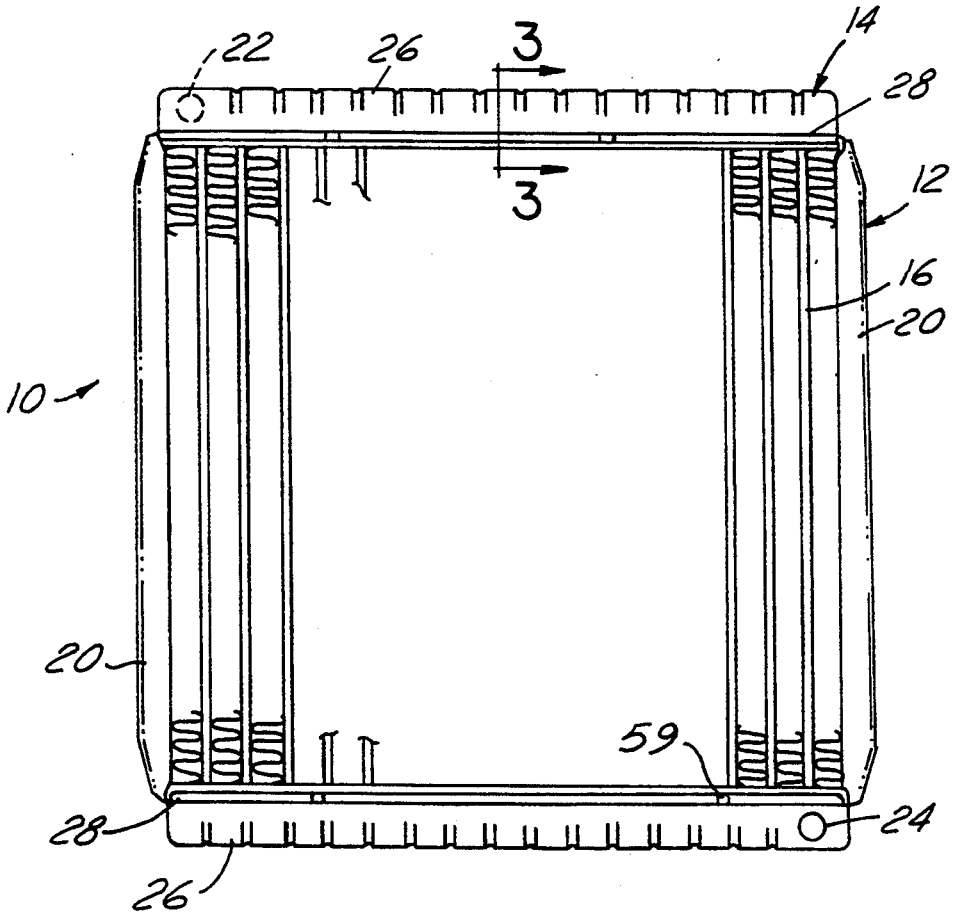
FIG. 1
FIG. 2
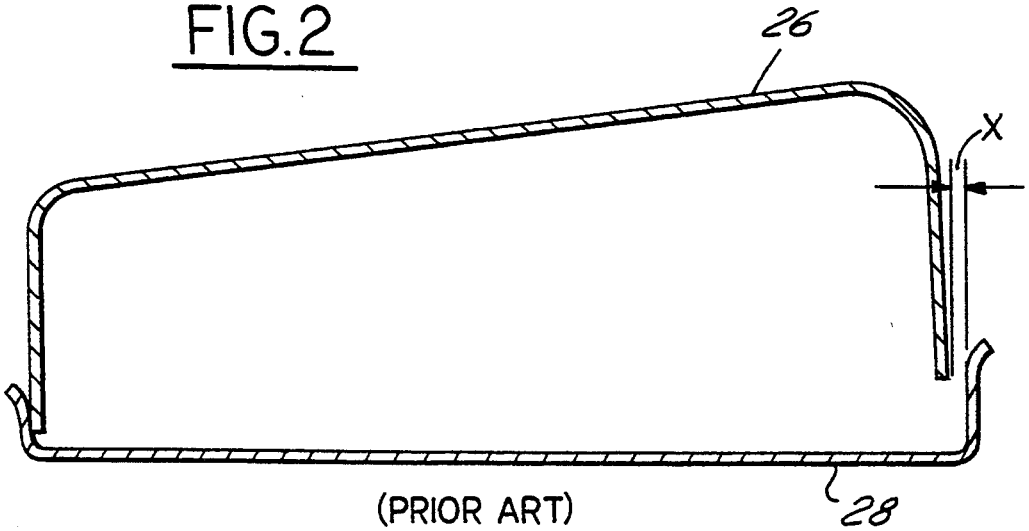
(PRIOR ART)

HEAT EXCHANGER MANIFOLD ASSEMBLY

BACKGROUND OF THE INVENTION

1. Field of the Invention

The present invention relates generally to heat exchanger assemblies. More particularly, the present invention relates to a manifold assembly for a heat exchanger for an automotive vehicle.

2. Disclosure Information

A typical automotive heat exchanger such as a radiator, includes a manifold assembly which conducts fluid flow through a plurality of flow tubes to reduce the operating temperature of the vehicle as is well known in the art. A manifold typically includes a tank member and a header member joined together. Various solderless tank-to-header joint arrangements have been proposed such as shown in British Patent No. 699,032. In these prior art arrangements, portions of the edges of the headers or associated separate clips formed on the headers are crimped onto flanges formed on the respective tanks to compress an o-ring or other shaped resilient gasket between the tank and the header. Typically, the headers are formed of a lighter gauge metal than the tanks or the tanks are formed of a suitable plastic with heavy gauge headers.

Numerous quality problems can be associated with the crimping process, such as shearing of the tabs on the header, failure to fully close the tabs resulting in leaks or a low burst strength of the manifold, or cracking the plastic tank and pinching or cutting the rubber o-ring. Furthermore, there are also design issues related to automotive radiators with plastic tanks. These include crevice corrosion under the o-ring, relaxation of the o-ring and cracking of the plastic tank caused by fatigue or calcium chloride attack. Because of these disadvantages, it would be desirable to build an all aluminum automotive radiator including a tank manufactured from an aluminum or aluminum alloy which would overcome the problems associated with the mechanical assembling of the tank-to-header joint.

Other automotive heat exchangers, such as heater cores, can also be manufactured from an aluminum alloy. However, the tank-to-header joint used on heater cores is primarily unsatisfactory due to assembly reasons. The heater core tank-to-header joint does not provide sufficient lead-in nor clearance for assembly of the tank to the header. Misaligned or improperly seated tanks can result in leaks after a brazing operation. A cam trimming operation in the stamping die must also be used on some tanks in order to assure a leak-free design. Therefore, it would be advantageous to provide a tank-to-header joint design which overcomes the problems associated with the prior art.

It is an object of the present invention to provide an all aluminum or aluminum alloy heat exchanger wherein the tank-to-header joint eliminates the problems inherent with the mechanical crimping or assembling as known in the prior art.

SUMMARY OF THE INVENTION

The present invention overcomes the disadvantages of the prior art by providing a manifold assembly for use with a heat exchanger having a plurality of fluid-carrying tubes for an automotive vehicle. The manifold assembly comprises an elongate tank member having a substantially U-shaped cross-section which defines an inner surface and an outer surface. The tank member comprises a base portion and a wall circumferentially surrounding the base portion which depends generally perpendicularly to the plane of the base portion. The wall includes a flange portion depending downwardly and outwardly from a terminating end thereof, the flange portion including a first arcuate portion and a second arcuate portion. The manifold assembly further includes an elongate header plate having a length substantially equal to the length of the tank member. The header plate comprises a base portion circumferentially surrounded by a flange portion depending outwardly therefrom. The base portion also includes a plurality of apertures therein for receiving the tubes of the heat exchanger therethrough. The flange portion of the header plate terminates in an arcuate portion configured to contact the first and second arcuate portions of the tank member such that at least one brazing surface is formed at the arcuate portions of the tank flange portion and the header plate flange portion by the engagement of the tank member to the header plate where the tank member and the header plate are assembled and brazed together.

A method for making such a manifold is also disclosed.

It is an advantage of the present invention to provide a manifold assembly for an automotive heat exchanger which can be fabricated from an aluminum alloy and provide a brazed joint between the tank and header portions of the manifold to ensure a leak-tight seal therebetween.

BRIEF DESCRIPTION OF THE DRAWINGS

FIG. 1 is a perspective view of an automotive radiator structured in accord with the principles of the present invention.

FIG. 2 is a cross-sectional view of a prior art manifold assembly for an automotive heat exchanger.

DETAILED DESCRIPTION OF THE PREFERRED EMBODIMENTS

Figure 3:
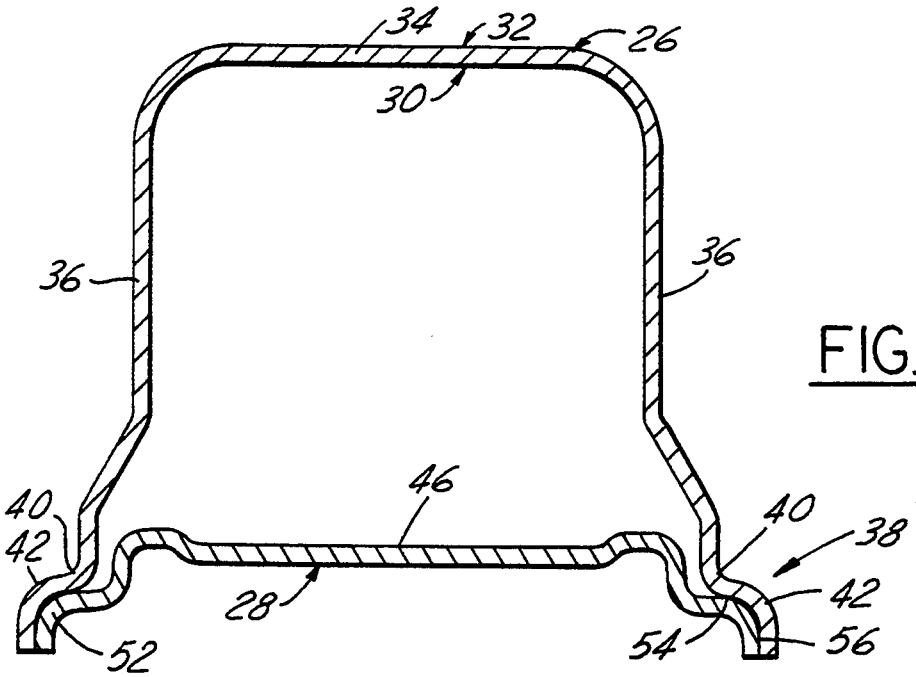
FIG. 3 is a cross-sectional view taken along line 3—3 of FIG. 1 of a manifold assembly structured in accord with the principles of the present invention.

Referring now to the drawings, FIG. 1 shows an automotive heat exchanger 10, such as a radiator, including a core 12 comprising a plurality of tubes 16 interleaved with a plurality of fins 18 as is well known in the art. The radiator 10 includes a manifold assembly 14 through which fluid flows into each of the tubes 16. As is known in the art, the radiator 10 can either include a single manifold disposed at one end of the core 12 or may have a pair of manifolds disposed at opposite ends of the core. A pair of side supports 20 are disposed on opposite sides of the core 12 and provides structural rigidity to the radiator 10. The manifold 14 includes a fluid inlet port 22 and a fluid outlet port 24 for the entry and exit of a fluid into the radiator 10.

FIG. 2 illustrates a typical prior art manifold for a heat exchanger, such as a heater core. The manifold includes a tank member 26 and header plate 28 which are joined together to form the fluid-conducting manifold. In a typical prior art design, the tank member 26 has a generally U-shaped cross-section which fits into upstanding walls of a header plate. Because of manufacturing intolerances, it is often difficult to-obtain a tight seal between the tank member 26 and header 28 such as shown by the distance "X" in FIG. 2. Furthermore, the terminating edge of the tank member 26 must be flat around its periphery, often necessitating a cam trimming operation to achieve a flat seal between the tank member 26 and header 28. Furthermore, because of the radius at the interface of the header wall and the header base, there is no true surface for the terminating edge of the tank to engage, further increasing the probability of leakage therearound. Because of this, it is difficult to control the tank entry into the header, often resulting in a crooked or cocked tank as shown in FIG. 2.

The present invention overcomes these problems associated with the prior art by providing a tank member and header plate as shown in FIG. 3. The tank member 26 includes a base portion 34 and defines an inner surface 30 and outer surface 32. A wall 36 circumferentially surrounds the base portion 34 and depends generally perpendicularly to the plane of the base portion 34. A flange portion 38 is circumferentially disposed on the terminating end of the wall 36. The flange portion 38 depends downwardly and outwardly from the wall and is generally S-shaped in configuration. The flange includes a first arcuate portion 40 having a radius of curvature relative to the inner surface 30 of the tank member 26 of $R_1$ and a second arcuate portion 42 having a predetermined radius of curvature relative to the inner surface 30 of the tank 26 of $R_2$.

Figure 5:
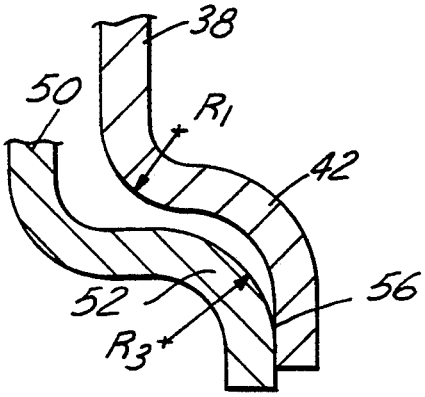
FIGS. 5 and 6 are enlarged views of the tank-to-header joint of a manifold structured in accord with the principles of the present invention.
Figure 6:
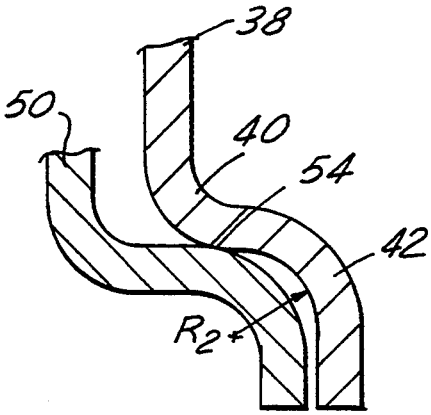
Figure 4:
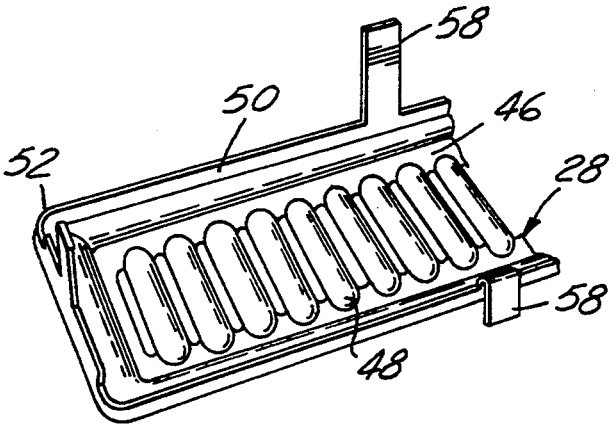
FIG. 4 is a perspective view of a header plate of the present invention.

As shown in FIG. 4, the header plate 28 is substantially equal in length to the length of the tank member 26 and includes a generally planar base portion 46 which has a plurality of tube-receiving apertures 48 therein for receiving the ends of the fluid-conducting tubes therethrough. The base portion 46 of the header plate 28 is circumferentially surrounded by a second flange portion 50 which depends outwardly therefrom. The flange portion 50 terminates in an arcuate portion 52 having a predetermined radius of curvature relative to the top surface of the header plate 28 of $R_3$. As shown in FIGS. 5 and 6, the radius of curvature of the arcuate portion 52 of the header flange portion 50 ($R_3$) is greater than the radius of curvature of the second arcuate portion 42 of the tank flange portion 38 ($R_2$). As such, when the tank member 26 is placed in mating contact with the header plate 28, the flange portions 38, 50, respectively of the tank 26 and header 28 engage to form a pair of contact brazing surfaces 54, 56. As such, when the completed manifold assembly is subjected to a brazing operation, a leak-free seal is ensured because of the pair of brazing surfaces formed by the mating engagement of the tank 26 to the header plate 28.

The present invention solves the problems associated due to manufacturing intolerances as shown by FIGS. 5 and 6. In the embodiments shown in FIG. 5, the header plate 28 is enlarged beyond its design width. However, because the radius $R_3$ of the arcuate portion 52 is greater than the radius of curvature $R_2$ of the arcuate portion 42 of the tank, at least one brazing contact surface 56 remains to ensure a leak-free seal between the tank and the header. FIG. 6 illustrates the situation wherein the header plate 28 is formed Smaller than the design width specified for the tank member. In this situation, at least one brazing contact surface 54 is formed between the first arcuate portion 40 of the tank member and the arcuate portion 50 of the header plate. Therefore, the design of the present invention allows for slight manufacturing intolerances which would not be tolerated in prior art designs. Furthermore, in utilizing the design of the present invention, the need for mechanically crimping the tank to the header and thereby compressing an o-ring is eliminated since the brazed joint 54, or 56, prevents the leakage of fluid therepast. However, tab members 58 may still be formed on the header plate 28 to ensure location and fit of the header to the tank and prevent the assembly from becoming separated prior to and during the brazing operation. Alternatively, tabs 59 may be formed on the tank member.

The present invention also provides an advantage in that the smooth radius on the header plate 28 in the arcuate portion 52 provides a positive lead-in to guide a mis-aligned tank 26 into proper position.

By utilizing the present invention, the tank member and the header plate can be formed of aluminum and aluminum alloy materials suitable for furnace brazing. At least one of the flange portions 38, 50 are coated with a lower temperature clad brazing material to ensure a suitable brazing joint between the tank 26 and the header plate 28.

A method for making Such a manifold is also contemplated by the present invention. The method comprises the steps of forming an elongated tank member in a stamping operation, the tank having a substantially U-shaped cross-section which defines an inner and an outer surface. The tank includes the base portion and a wall circumferentially surrounding the base portion and depending generally perpendicular to the plane thereof as described above. Next, a flange portion is formed on a terminating end of the wall around the entire circumference thereof, such that the flange portion is S-shaped and includes the first arcuate portion 40 and the second arcuate portion 42 having a predetermined radius of curvature relative to the inner surface of the tank member 26. The next step includes forming an elongated header plate having a length substantially equal to the length of the tank member, the header plate having a generally planar base portion 46 with a plurality of apertures formed therein for receiving the tubes of the heat exchangers therethrough. The method further comprises the step of forming a flange portion 50 circumferentially surrounding the base portion 46 of the header 28 such that the flange portion 50 depends outwardly therefrom and terminates in an arcuate portion 52, having a predetermined radius of curvature relative to the top surface of the header plate. This predetermined radius of curvature must be greater than the radius of curvature of the second arcuate portion 42 of the tank member 26 as described above. The tank member is then placed into mating engagement with the header plate 28 such that a pair of brazing surfaces are formed at the second arcuate portion of the tank flange portion in the header plate flange portion. Finally, the completed heat exchanger core having the assembled manifold is placed into a brazing furnace, and the tank member and header plate are brazed together at predetermined temperatures as is well known in the art.

Various other modifications and alterations to the present invention will, no doubt, become apparent to those skilled in the art. For example, the principles of the present invention can be applied to other types of heat exchangers, such as charge air coolers used in vehicle engine superchargers. Therefore, it is the following claims, including all equivalents, which define the scope of the invention.

What is claimed is:

1. A manifold assembly for use with a heat exchanger having a plurality of fluid carrying tubes for an automotive vehicle, comprising:

an elongate tank member having a substantially U-shaped cross-section and defining an inner surface and an outer surface, said tank comprising a base portion and a wall circumferentially surrounding the base portion and depending generally perpendicularly to the plane thereof, said wall including a flange portion depending downwardly and outwardly from a terminating end thereof, said flange portion including a first arcuate portion having a first predetermined radius of curvature relative to the inner surface and a second arcuate portion having a first predetermined radius of curvature relative to the inner surface of said tank; and an elongate header plate having a length substantially equal to the length of said tank member, said header plate comprising a base portion circumferentially surrounded by a flange portion depending outwardly therefrom, said base portion including a plurality of apertures therein for receiving the tubes of the heat exchanger therethrough, said flange portion terminating in an arcuate portion configured to contact said first and second arcuate portions of said tank member, said arcuate portion of said flange portion having a first predetermined radius of curvature relative to the top surface of said header plate, said first radius of curvature of said flange portion being greater than the radius of curvature of said second arcuate portion of said tank flange portion, such that at least one brazing surface is formed at said arcuate portions of said tank flange portion and said header plate flange portion by the engagement of said tank member to said header plate when said tank member and said header plate are brazed together.

2. A manifold assembly according to claim 1, wherein a pair of brazing surfaces are formed at said arcuate portions of said tank flange portion and said header plate flange portion by the engagement of said tank member to said header plate when said tank member and said header plate are brazed together.

3. A manifold assembly according to claim 1, wherein said tank member and said header plate are formed of aluminum alloy materials suitable for furnace brazing, with at least one of said flange portions being coated with a lower temperature clad brazing material.

4. A manifold assembly according to claim 1, wherein said tank member includes a plurality of tab members adapted to engage the header plate.

5. A manifold assembly according to claim 1, wherein said header plate includes a plurality of tab members adapted to be crimped over the outer surface of the wall of the tank member.

6. A manifold assembly for use with a radiator having a plurality of fluid carrying tubes for an automotive vehicle, comprising:

an elongate tank member having a substantially U-shaped cross-section and defining an inner surface and an outer surface, said tank comprising a base portion and a wall circumferentially surrounding the base portion and depending generally perpendicularly to the plane thereof, a flange portion circumferentially disposed on the terminating ends of said wall, said flange portion depending downwardly and outwardly therefrom and being generally S-shaped, said flange portion including a first arcuate portion and a second arcuate portion, said first arcuate portion having a first predetermined radius of curvature relative to the inner surface of said tank member, said second arcuate portion having a first predetermined radius of curvature relative to the inner surface of said tank; and an elongate header plate having a length substantially equal to the length of said tank member, said header plate comprising a base portion circumferentially surrounded by a flange portion depending outwardly therefrom, said base portion including a plurality of apertures therein for receiving the tubes of the heat exchanger therethrough, said flange portion terminating in an arcuate portion having a first predetermined radius of curvature relative to the top surface of said header plate, said first radius of curvature of said arcuate portions of said header flange portion being greater than the radius of curvature of said second arcuate portion of said tank flange portion, such that a pair of brazing surfaces are formed at said arcuate portions of said tank flange portion and said header plate flange portion by the engagement of said tank member to said header plate when said tank member and said header plate are brazed together.

7. A manifold assembly according to claim 1, wherein said tank member and said header plate are formed of aluminum and aluminum alloy materials suitable for furnace brazing, with at least one of said flange portions being coated with a lower temperature clad brazing material.

8. A method of making a manifold assembly for use with a heat exchanger having a plurality of fluid carrying tubes for an automotive vehicle, comprising the steps of:

forming an elongate tank member having a substantially U-shaped cross-section which defines an inner surface and an outer surface, said tank comprising a base portion and a wall circumferentially surrounding the base portion and depending generally perpendicularly to the plane thereof;

forming a flange portion on a terminating end of said wall around the entire circumference thereof such that said flange portion is S-shaped and includes a first arcuate portion and a second arcuate portion, said second arcuate portion having a first predetermined radius of curvature relative to the inner surface of said tank;

forming an elongate header plate having a length substantially equal to the length of said tank member, said header plate comprising a generally planar base portion;

forming a plurality of apertures in said base portion of said header plate for receiving the tubes of the heat exchanger therethrough;

forming a flange portion circumferentially surrounding said base portion of said header plate such that said flange portion depends outwardly therefrom and terminates in an arcuate portion having a first predetermined radius of curvature relative to the top surface of said header plate which is greater than the first radius of curvature of said second arcuate portion of said tank flange portion;

placing said tank member into mating engagement with said header plate such that a pair of brazing surfaces are formed at said second arcuate portion of said tank flange portion and said header plate flange portion; and brazing the tank member to the header plate assembly in a brazing furnace at a predetermined temperature.

* * * * *